US011732950B2

(12) United States Patent
Mobley et al.

(10) Patent No.: US 11,732,950 B2
(45) Date of Patent: Aug. 22, 2023

(54) PRESSURE RELIEF JUMPER DRAIN FOR AN APPLIANCE

(71) Applicant: Electrolux Home Products, Inc., Charlotte, NC (US)

(72) Inventors: Benjamin Mobley, Iva, SC (US); William Lee Moody, Anderson, SC (US); Marcelo C. Candeo, Anderson, SC (US); Dennis Schenk, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/240,135

(22) Filed: Apr. 26, 2021

(65) Prior Publication Data

US 2022/0341647 A1 Oct. 27, 2022

(51) Int. Cl.

| | |
|---|---|
| ***F25D 17/04*** | (2006.01) |
| ***F25D 21/14*** | (2006.01) |
| ***F25D 23/00*** | (2006.01) |
| ***F25D 23/06*** | (2006.01) |

(52) U.S. Cl.

CPC ..... *F25D 17/047* (2013.01); *F25D 21/14* (2013.01); *F25D 23/006* (2013.01); *F25D 23/061* (2013.01); *F25D 23/062* (2013.01); *F25D 2321/146* (2013.01)

(58) Field of Classification Search

CPC ..... F25D 17/047; F25D 21/14; F25D 23/006; F25D 23/061; F25D 23/062; F25D 2321/146; F25D 2321/14

See application file for complete search history.

(56) References Cited

U.S. PATENT DOCUMENTS

| | | | |
|---|---|---|---|
| 1,235,304 | A | 7/1917 | Foster |
| 1,504,126 | A | 10/1923 | Lassell |
| 3,696,632 | A | 10/1972 | Carlin et al. |
| 5,499,514 | A | 3/1996 | Ho |

(Continued)

FOREIGN PATENT DOCUMENTS

| | | |
|---|---|---|
| CN | 106907895 | 6/2017 |
| CN | 109696002 | 4/2019 |

(Continued)

OTHER PUBLICATIONS

KR 20140099105 A Translation (Year: 2014).*

International Search Report and Written Opinion for PCT/US2022/025260, dated Jul. 25, 2022, 14 pages.

*Primary Examiner* — Elizabeth J Martin

*Assistant Examiner* — Dario Antonio Deleon

(74) *Attorney, Agent, or Firm* — Pearne & Gordon LLP

(57) ABSTRACT

A jumper drain for a refrigerator appliance, the jumper drain including a housing with a cavity defined therein and that is in fluid communication with a storage compartment of the refrigerator appliance. An inlet and an outlet extend from the housing and are both in fluid communication with the cavity. The outlet is disposed at a location that is offset from the inlet. A pressure equalizer opening is formed in the housing. The pressure equalizer opening is configured to provide fluid communication between the cavity and an ambient environment external to the refrigerator appliance in order to equalize a pressure differential within the refrigerator appliance.

17 Claims, 8 Drawing Sheets

(56) References Cited

U.S. PATENT DOCUMENTS

| | | | | |
|---|---|---|---|---|
| 5,557,942 | A | 9/1996 | Kim et al. | |
| 5,836,170 | A | 11/1998 | Perkins et al. | |
| 6,672,094 | B1 | 1/2004 | Carden et al. | |
| 6,672,096 | B2 | 6/2004 | Lopes | |
| 7,340,916 | B2 | 3/2008 | Kim | |
| 8,826,944 | B1 | 9/2014 | Laine | |
| 9,046,301 | B2 | 6/2015 | Park et al. | |
| 9,212,844 | B2 | 12/2015 | Lee et al. | |
| 9,726,421 | B2 | 8/2017 | Kempfle | |
| 9,863,689 | B2 | 1/2018 | Lee et al. | |
| 10,690,390 | B2 | 6/2020 | Kim et al. | |
| 2006/0277934 | A1 | 12/2006 | Cho | |
| 2010/0269531 | A1 | 10/2010 | Samdan et al. | |
| 2012/0180514 | A1* | 1/2012 | Lee et al. | F25D 17/047 62/285 |
| 2012/0266626 | A1 | 10/2012 | Kim | |
| 2017/0045286 | A1 | 2/2017 | Ungor et al. | |
| 2021/0095912 | A1* | 4/2021 | Reynolds et al. | F25D 17/047 |

FOREIGN PATENT DOCUMENTS

| | | | | |
|---|---|---|---|---|
| CN | 110388781 | | 10/2019 | |
| DE | 2435849 | | 2/1975 | |
| DE | 102010017919 | | 10/2011 | |
| EP | 0848217 | | 6/1998 | |
| FR | 2647193 | | 11/1990 | |
| JP | 2001033148 | | 2/2001 | |
| JP | 2005226964 | | 8/2005 | |
| KR | 100214621 | | 8/1998 | |
| KR | 100274502 | | 7/1999 | |
| KR | 100681940 | | 2/2007 | |
| KR | 20070027307 | | 3/2007 | |
| KR | 101456626 | | 8/2014 | |
| KR | 20140099105 | A * | 8/2014 | F25D 17/045 |
| KR | 101815985 | | 3/2017 | |
| WO | 2007023471 | | 3/2007 | |
| WO | 2009132940 | | 11/2009 | |
| WO | 2010/133433 | | 11/2010 | |
| WO | 2010/139534 | | 12/2010 | |

* cited by examiner

PRESSURE RELIEF JUMPER DRAIN FOR AN APPLIANCE

FIELD OF THE INVENTION

This application relates generally to a jumper drain configured to direct liquid condensate to a drain pan disposed within a machine compartment of a refrigerator appliance, and more particularly, a jumper drain providing fluid communication between a storage compartment of the refrigerator appliance and an ambient environment thereof in order to equalize a pressure differential within the refrigerator appliance.

BACKGROUND OF THE INVENTION

Conventional appliances, including refrigeration appliances, often suffer from the creation of a vacuum when a door of the appliance is closed too quickly or slammed shut. In particular, when the door is closed too quickly, air within a storage compartment of the appliance is forced out (to an ambient environment) causing a vacuum to form within the appliance. Moreover, sometimes when the door is opened and closed quickly, the relatively warmer ambient air rushes inside the storage compartment, and more specifically, to the evaporator. This also creates a vacuum within the appliance.

The formation of the vacuum within the appliance makes is difficult to reopen the door for a short time period (generally a few seconds). More specifically, the door will remain difficult to reopen until the pressure within the appliance equalizes. This phenomena reduces the user's overall experience with the appliance.

BRIEF SUMMARY OF THE INVENTION

In accordance with one aspect, there is provided a jumper drain for a refrigerator appliance that provides fluid communication between a storage compartment and a machine compartment via a drain. The drain collects and transfers liquid condensate from an evaporator. The jumper drain includes a housing with a cavity defined therein. The cavity is in fluid communication with the storage compartment. An inlet extends from the housing and is in fluid communication with the cavity. An outlet extends from the housing and is in fluid communication with the cavity. The outlet is disposed at a location that is offset from the inlet. A pressure equalizer opening is formed in the housing and is configured to provide fluid communication between the cavity and an ambient environment external to the refrigerator appliance in order to equalize a pressure differential within the refrigerator appliance.

In accordance with another aspect, there is provided an appliance including a cabinet defining a storage compartment for storing food items in a cooled environment. The appliance also includes an evaporative cooling system configured to reduce a temperature of the storage compartment. The evaporative cooling system includes an evaporator, a condenser, and a condenser fan, wherein the evaporator is positioned within the storage compartment, and wherein the condenser and the condenser fan are positioned within a machine compartment disposed beneath and external to the storage compartment.

A drain is disposed below the evaporator and is configured to collect and transfer liquid condensate from the evaporator. The drain is in fluid communication with the storage compartment. A jumper drain includes a housing with a cavity defined therein. The cavity is in fluid communication with the drain. A pressure equalizer opening is formed in the housing and provides fluid communication between the cavity and an ambient environment external to the appliance, thereby providing fluid communication between the storage compartment and the ambient environment in order to equalize a pressure differential within the appliance.

In accordance with yet a further aspect, there is provided a jumper drain for a refrigerator appliance that provides fluid communication between a storage compartment and a machine compartment via a drain. The drain collects and transfers liquid condensate from an evaporator. The jumper drain includes a housing having a body and a lid that collectively define a cavity within the housing. The lid is pivotably attached to the body at a side thereof via a hinge such that the lid is pivotable between a closed state and an open state. The housing is disposed within the machine compartment and on a negative pressure side of a condenser fan.

The jumper drain further includes an inlet and an outlet disposed at opposite respective ends of the body and extending in opposite respective directions away from the body. The inlet is configured to engage with a first conduit that provides fluid communication between the drain and the cavity, and the outlet is configured to engage with a second conduit that guides a flow of said liquid condensate to a drain pan. A pressure equalizer opening is formed in a face of the housing and provides fluid communication between the cavity and an ambient environment external to the refrigerator appliance in order to equalize a pressure differential within the refrigerator appliance. A wall projects outwards from the face in a direction away from the housing. The wall peripherally surrounds the pressure equalizer opening. Further, first and second cutout portions are formed in the body and the lid, respectively, such that when the lid is provided in the closed state, the first and second cutout portions define the pressure equalizer opening.

DESCRIPTION OF EXAMPLE EMBODIMENTS

Figure 1:
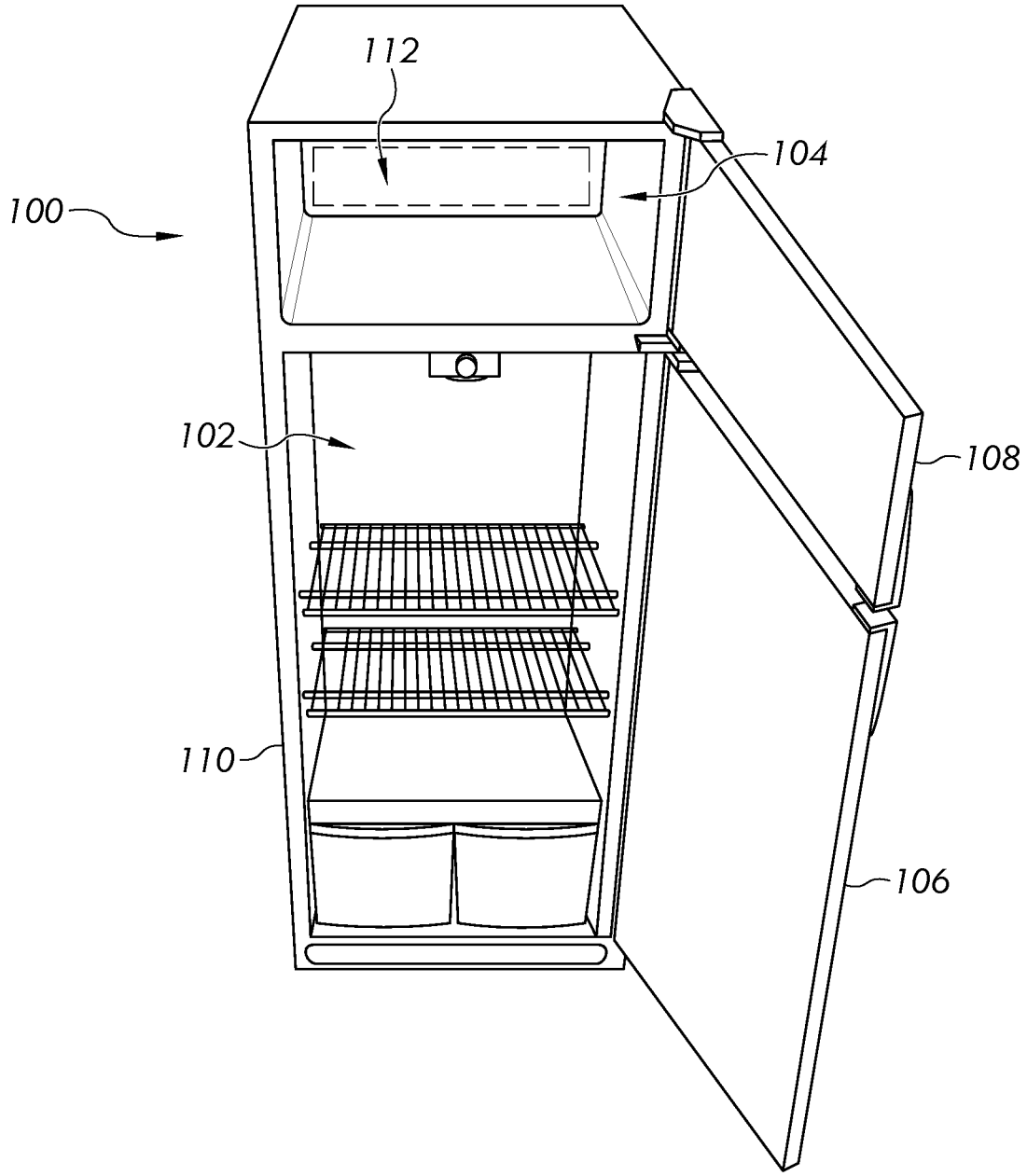
FIG. 1 is a front perspective view of an example refrigeration appliance.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. For example, the various embodiments of the jumper drain assembly (discussed below) can be embodied in various other appliances. Further, an embodiment is described in detail below, and shown in the figures as a top-mount configuration of a refrigerator 100, including a fresh-food compartment 102 disposed vertically below a freezer compartment 104. Still, it is to be understood that the refrigerator can have any desired configuration including at least a fresh-food compartment and/or a freezer compartment, such as a bottom mount refrigerator (freezer disposed beneath the fresh food compartment), a side-by-side refrigerator (fresh food compartment is laterally next to the freezer compartment), a standalone refrigerator or freezer, a refrigerator having a compartment with a variable climate (i.e., can be operated as a fresh-food or a freezer compartment), etc.

A fresh-food compartment door 106 and a freezer compartment door 108, shown in FIG. 1, are pivotably coupled to a cabinet 110 of the refrigerator 100 to selectively restrict and grant access to the fresh-food compartment 102 and the freezer compartment 104, respectively. As shown, each of the fresh-food compartment and freezer compartment doors 106, 108 are single doors that span the entire lateral distance of the fresh-food and freezer compartments 102, 104 respectively. It is to be understood that other configurations are contemplated (e.g., the fresh-food and/or freezer compartments 102, 104 having French-type doors that collectively span the entire lateral distance of the entrance of the fresh-food and/or freezer compartment 102, 104).

The freezer compartment 104 is used to freeze and/or maintain articles of food stored therein in a frozen condition. For this purpose, the freezer compartment 104 is in thermal communication with a freezer evaporator 112 (shown schematically in FIG. 1) that removes thermal energy from the freezer compartment 104 to maintain the temperature therein at a user-selectable target freezer temperature, e.g., a temperature of 0° C. or less during operation of the refrigerator 100, preferably between 0° C. and −50° C., more preferably between 0° C. and −30° C. and even more preferably between 0° C. and −20° C.

The fresh-food compartment 102 serves to minimize spoiling of articles of food stored therein. This is accomplished by maintaining the temperature in the fresh-food compartment 102 at a cool temperature that is typically above 0° C., so as not to freeze the articles of food in the fresh-food compartment 102. It is contemplated that the cool temperature is a user-selectable target fresh-food temperature preferably between 0° C. and 10° C., more preferably between 0° C. and 5° C. and even more preferably between 0.25° C. and 4.5° C. The fresh-food compartment 102 may include a dedicated fresh-food evaporator (not shown) to separately maintain the temperature within the fresh-food compartment 102 independent of the freezer compartment 104. Alternatively, the fresh-food compartment 102 may be in thermal communication with the freezer evaporator 112 such that the freezer evaporator 112 maintains the temperature of the fresh-food compartment 102 at a desired temperature setpoint.

The removal of thermal energy from the freezer compartment 104 results in condensation build-up around coils (not shown) of the freezer evaporator 112, which can form frost or ice that is periodically removed by a defrost operation. Specifically, during the defrost operation, an electric heater (not shown) is operated to raise the temperature of the coils of the freezer evaporator 112 to melt the frost or ice into liquid (e.g., water) condensate. This condensate drips from the freezer evaporator 112 to a draining assembly (including an interior cabinet drain 114, shown in FIG. 9) that is in fluid communication with a machine compartment 116 (shown in FIG. 2). In other words, the draining assembly is in fluid communication with the freezer compartment 104.

Figure 2:
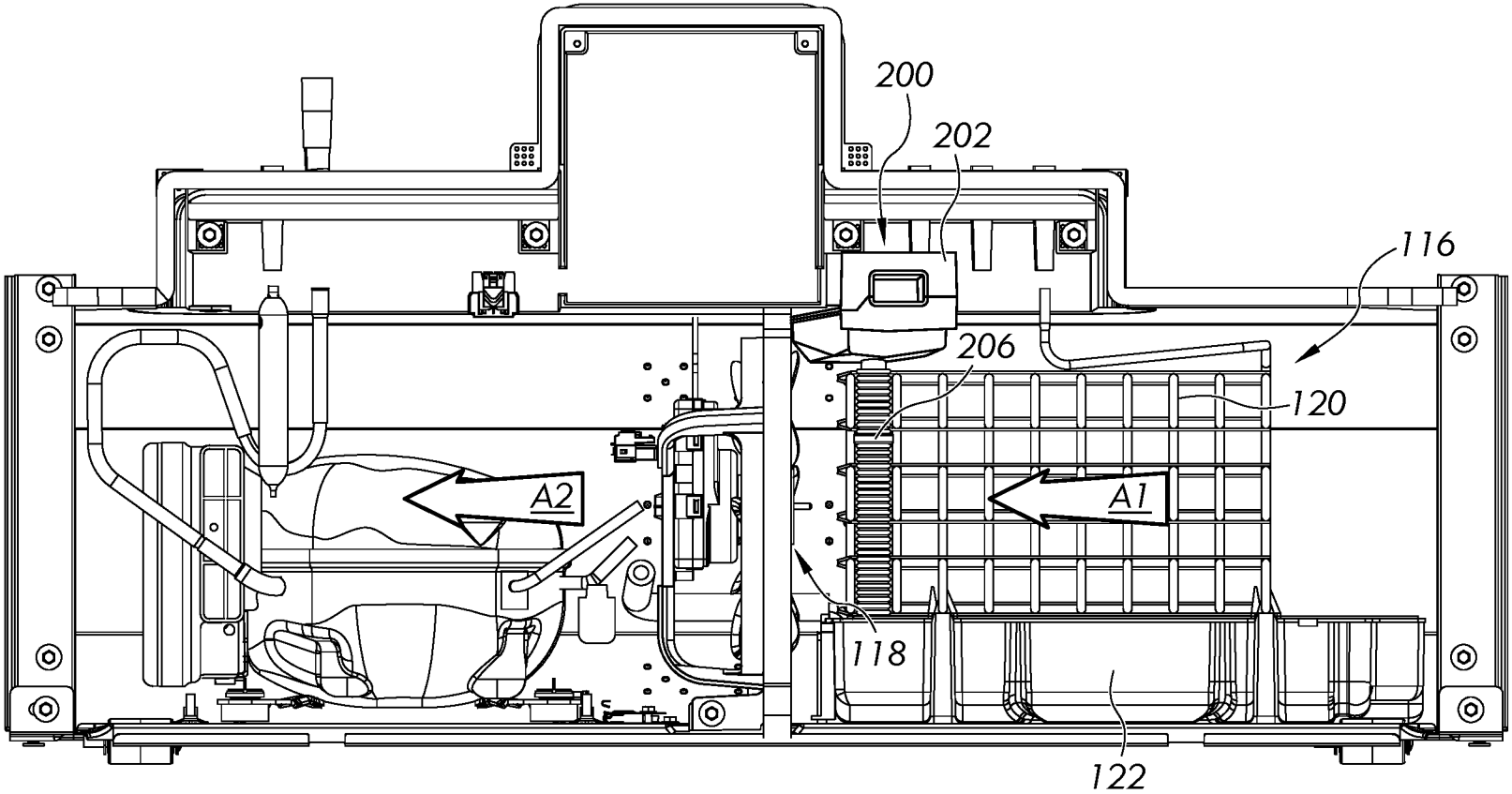
FIG. 2 is a front view of a machine compartment located at a rear of the refrigeration appliance, and depicting a first embodiment of a drain jumper assembly.

FIG. 2 is a front view of the machine compartment 116, which is located at a rear of the refrigerator 100. The machine compartment 116 is generally located external to and below the fresh-food and freezer compartments 102, 104 and contains operative elements of the refrigerator's evaporative cooling system (e.g., a compressor, condenser, condenser fan, etc.). Specifically, a condenser fan 118, a condenser 120 (e.g., condenser coil arrangement), and a drain pan 122 are all disposed within the machine compartment 116. During operation, the above-noted liquid condensate is directed to the drain pain 122 via the draining assembly (e.g., including a jumper drain 202, discussed in greater detail below), and the condenser fan 118 generates an airflow to cool refrigerant flowing through the condenser 120 (as well as other operative elements, e.g., the compressor, etc.). The latent heat from the condenser 120, together with this airflow, also helps to evaporate the liquid condensate collected in the drain pan 122.

More specifically, the airflow is generated by the condenser fan 118 pulling air across the condenser 120 (i.e., in a direction from right to left, as indicated by arrow A1 shown in FIG. 2) and expelling that air to an opposite side thereof (as indicated by arrow A2 shown in FIG. 2). Accordingly, a pressure differential is created across the condenser fan 118 whereby a negative pressure is generated on an upstream airflow side of the condenser fan 118 (i.e., a location wherein arrow A1 is disposed).

As briefly mentioned above, when a user opens a door of the refrigerator 100 (e.g., either the fresh-food or freezer compartment doors 106, 108) from a closed position, an undesired negative-pressure vacuum can be created within the refrigerator 100, including within the draining assembly. Such a vacuum can inhibit the user from re-opening the door for a short period of time or even cause other problems with warm exterior air flow being drawn into the refrigerator interior. Reference will now be made to various embodiments of jumper drain assemblies, all configured to provide the dual benefit of enabling liquid water to drain out of the interior cabinet 110 and also to mitigate the undesired vacuum by equalizing a pressure differential between an interior of the cabinet 110 (e.g., the fresh-food compartment 102, and/or the freezer compartment 104,) and an ambient environment (i.e., an external environment of the refrigerator 100). As shown in FIG. 2, a first embodiment of a jumper drain assembly 200 is disposed within the machine compartment 116, and more particularly, on the negative pressure side of the condenser fan 118. It is to be understood that each of the other below-described jumper drain assemblies likewise is disposed in a similar location within the machine compartment 116 (i.e., on the negative pressure side of the condenser fan 118).

Figure 3:
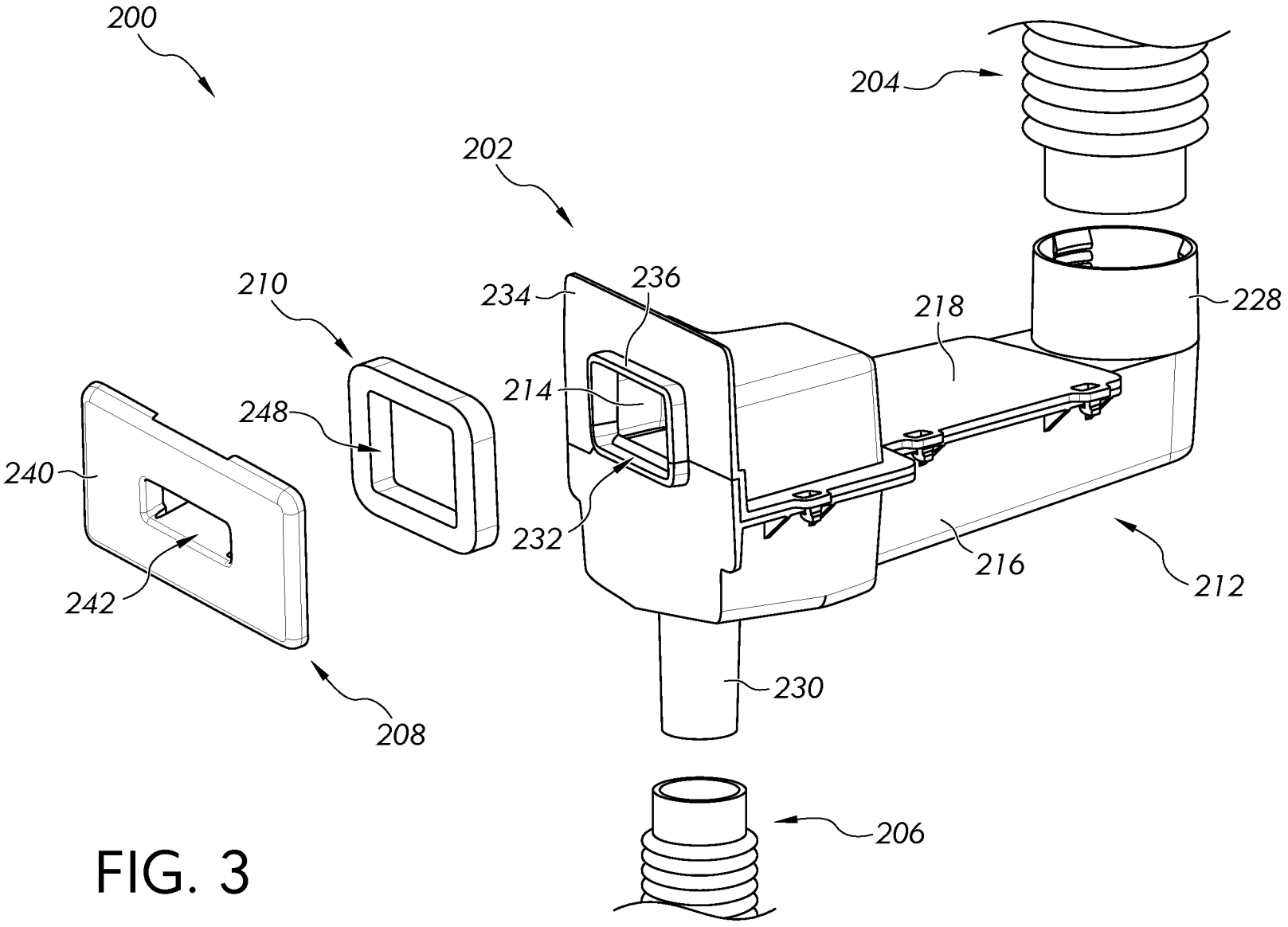
FIG. 3 is an exploded view of select features of the first embodiment of the drain jumper assembly, including an example drain jumper, conduits, a gasket, and a cover.

Now moving on to FIG. 3, select features of an example of the first embodiment of the jumper drain assembly 200 are shown in an exploded view. As shown, the jumper drain assembly 200 includes a jumper drain 202, a first (inlet) conduit 204, a second (outlet) conduit 206, a cover plate 208, and a gasket 210.

Figure 4:
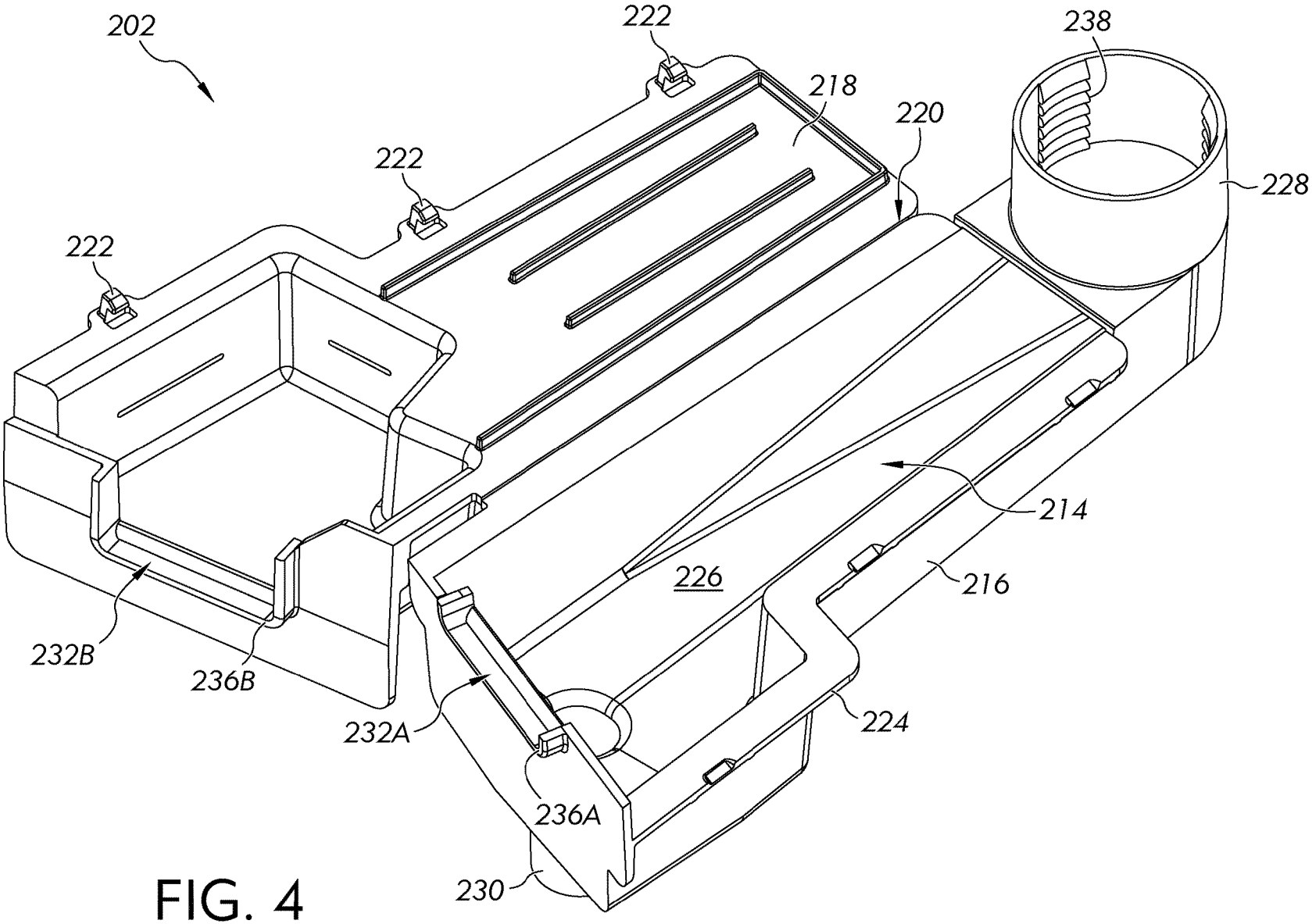
FIG. 4 is a perspective view of the example jumper drain of the first embodiment, shown in an opened state.

The depicted jumper drain 202 includes a hollow housing 212 having a cavity 214 defined therein (see FIG. 4). The housing 212 is formed by a body 216 and a lid 218. The lid 218 is pivotably secured to a side of the body 216 such that the jumper drain 202 may be provided in a closed state (as shown in FIG. 3) or an opened state (as shown in FIG. 4). More specifically, with reference to FIG. 4, the lid 218 is pivotably attached to the body 216 by a living hinge 220. It is to be understood that the hinge 220 need not be a living hinge, for example the hinge 220 could alternatively be a piano hinge, a butterfly hinge, a flush hinge, a barrel hinge, a spring hinge, or any other suitable type of hinge means. Further, FIG. 4 depicts only a single hinge 220 extending along a majority of the length of the side of the body 216. Alternatively, multiple hinges may be provided at spaced locations along the side of the body 216 in order to collectively pivotably secure the lid 218 thereto.

As further shown in FIG. 4, the lid 218 includes a series of resilient clips 222 disposed on a side of the lid 218 opposite to where the hinge 220 is secured to the lid 218. The resilient clips 222 are spaced one from the other along the length of the lid 218 and are generally hook-shaped. The resilient clips 222 are configured to secure the lid 218 to the body 216 such that the jumper drain 202 remains in the closed state (as shown in FIG. 3). In particular, each resilient clip 222 is configured to engage a flange 224 of the body 216 on a corresponding side thereof. For example, the lid 218 may be pivoted towards the closed state such that the resilient clips 222 physically contact the flange 224 and are resiliently moved away therefrom until the resilient clips 222 snap connect to the flange 224 via an inherent biasing force, thereby locking the lid 218 in place. To unlock the lid 218, a user need only (laterally) move the resilient clips 222 away from the flange 224 (against their biasing force) until they no longer engage the flange 224. Thereafter, the lid 218 can be pivoted to the opened state.

While FIG. 4 depicts a total of three resilient clips 222 it is to be understood that any number of resilient clips 222 may be employed. Moreover, it is to be understood that the lid 218 may be securely locked to the body 216 by means other than the above-noted resilient clip connection (e.g., snaps, ties, screws, etc.). In other embodiments, it is contemplated that the lid 218 need not be pivotably secured to the body 216. For example, resilient clips may be provided on opposite sides of the lid 218 in order to engage corresponding, opposite flanges of the body 216. In this manner, the lid 218 can be freely removed (i.e., completely separated) from the body 216 when the jumper drain 202 is in the opened state. Optionally, the lid 218 could even be permanently or integrally attached to the body 216. However, it can be helpful to have the lid 218 removable to simplify initial manufacturing or later service, such as to enable a cleanout of the cavity 214.

As further shown in FIG. 4, the body 216 is formed in the shape of a trough that defines the cavity 214. When the jumper drain 202 is in the closed state (as shown in FIG. 3) the lid 218 encloses the cavity 214. The body 216 has an inner guiding surface 226 that is inclined in the longitudinal direction from one end of the body 216 to an opposite end thereof, as further explained below.

Moving back to FIG. 3, the body 216 further includes an inlet 228 and an outlet 230 at opposite ends thereof. More specifically, the inlet 228 and the outlet 230 are linearly offset from one another along a longitudinal direction of the body 216. As further shown, each of the inlet 228 and the outlet 230 is in the shape of a hollow cylinder extending outwards and away from the body 216. For example, the inlet 228 extends vertically upwards from the body 216 whereas the outlet 230 extends vertically downwards from the body 216. It is to be understood that the inlet 228 and/or the outlet 230 may be in a shape other than a cylinder (e.g., cube, cuboid, triangular prism, etc.). The body 216, the inlet 228, and the outlet 230 can all be formed integrally (i.e., from a single material) during a single manufacturing process. However, it is contemplated that the inlet 228 and/or the outlet 230 can be formed separate and distinct from the body 216 and subsequently secured thereto.

Each of the inlet 228 and the outlet 230 is in fluid communication with the cavity 214 defined in the housing 212 in order to transport liquid condensate into and out of the jumper drain 202. As mentioned above, the inner guiding surface 226 (shown best in FIG. 4) is inclined (i.e., sloped) from one end of the body 216 to the other. More specifically, the inner guiding surface 226 is sloped vertically downwards in the direction from the inlet 228 towards the outlet 230. In this manner, as will be further explained below, liquid condensate entering into the jumper drain 202 (via the inlet 228) is easily directed (via gravity) to the outlet 230.

As further shown in FIG. 3, a pressure equalizer opening 232 (i.e., a through-hole) is formed in the housing 212, and more particularly, is a through-hole in the housing 212 leading into the cavity 214. The equalizer opening 232 is disposed at an end of the housing 212 corresponding to the location of the outlet 230. More specifically, the equalizer opening 232 is formed in a face 234 of the end of the housing 212. A wall 236 stands proud of the face 234 and is disposed about a periphery of the equalizer opening 232. That is, the wall 236 projects outwards from the face 234 in a direction away from the housing 212 and peripherally surrounds the equalizer opening 232.

As shown in FIG. 4, the equalizer opening 232 is split such that the equalizer opening 232 is defined by a first cutout portion 232A formed in the body 216 and a second cutout portion 232B formed in the lid 218, when the jumper drain 202 is in the closed state. The wall 236 likewise has this same split configuration. That is, a first section 236A of the wall 236 protrudes from the body 216 and extends along a periphery of the first cutout portion 232A and a second section 236B of the wall 236 protrudes from the lid 218 and extends along a periphery of the second cutout portion 232B. Accordingly, when the jumper drain 202 is in the opened state, the equalizer opening 232 is split into two, separate cutout portions formed in the body 216 and the lid 218, respectively. Thus, when the jumper drain 202 is in the closed state (as shown in FIG. 3), the equalizer opening 232 and its corresponding peripheral wall 236 are defined in the jumper drain 202. Alternatively, it is to be understood that the jumper drain 202 need not include this split configuration. For example, the equalizer opening 232 and the wall 236 can be formed entirely in either the body 216 or the lid 218 such that the equalizer opening 232 and the wall 236 are defined in the jumper drain 202 regardless of its assembled state (i.e., opened or closed).

Now moving back to FIG. 3, the first and second conduits 204, 206 are depicted as elongated, hollow tubes. Each of the first and second conduits 204, 206 is corrugated to promote easy manipulation (e.g., bending) during installation. The first and second conduits 204, 206 are configured to (removably) connect to the inlet 228 and the outlet 230, respectively. For example, one end of the first conduit 204 can have an outer diameter smaller than an inner diameter of the inlet 228. In this manner, the end of the first conduit 204 can be inserted into and received within the inlet 228. Moreover, an inner surface of the inlet 228 includes ribs 238 (best shown in FIG. 4) formed thereon (protruding radially inwards) and extending in an axial direction thereof. The ribs 238 are shaped to matingly engage with the corrugated design of the first conduit 204 to help secure the first conduit 204 in place within the inlet 228. Alternatively, the end of the first conduit 204 can have an inner diameter that is larger than an outer diameter of the inlet 228 such that the inlet 228 is inserted into and received within the end of the first conduit 204. It is to be understood that the second conduit 206 can likewise be secured to the outlet 230 of the housing 212 in the same or a similar manner as that described above.

Figure 5:
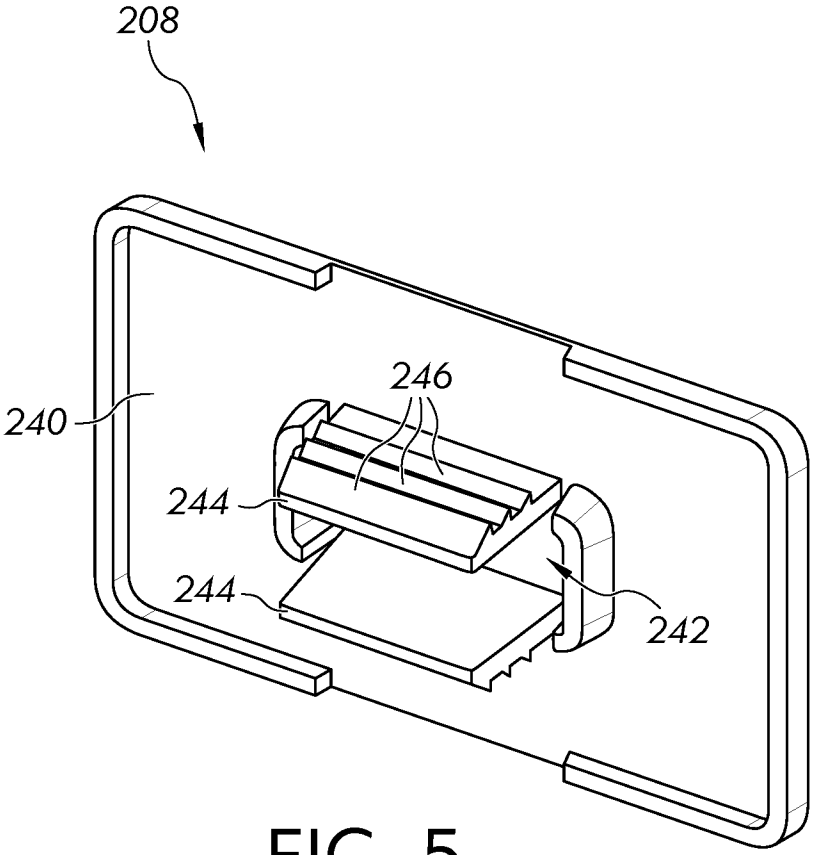
FIG. 5 is a rear view of the cover, shown in FIG. 3.

With respect to FIG. 3, a front view of the cover plate 208 is shown. More particularly, the cover plate 208 includes a plate-like body 240 having an aperture 242 (i.e., a through-hole) formed therein at a central location thereof. Briefly moving to FIG. 5, a rear view of the cover plate 208 is shown. A pair of resilient tabs 244 extend outwards and away from the plate-like body 240 (in a rearwards direction). The tabs 244 are disposed adjacent the aperture 242, and more particularly, are provided at opposite sides of the aperture 242 such that the tabs 244 are spaced from one another by the aperture 242. As further shown, each tab 244 includes a series of ridges 246 formed on outer surfaces thereof. The ridges 246 of each tab 244 are configured to secure the cover plate 208 to the jumper drain 202 in a ratchet-like manner, as will be further explained below. Moreover, while the depicted cover plate 208 is shown as only having two tabs 244, it is to be understood that the cover plate 208 may only have a single tab, or even more than two tabs (e.g., three, four, etc.).

Briefly moving back to FIG. 3, the gasket 210 (e.g., a rubber gasket, foam insulation, etc.) is shown as being substantially rectangular in shape and having a through-hole 248 formed at a central location thereon. More specifically, the gasket 210 is shown as being in the shape of a continuous rectangle, having four sides that are all connected together. It is to be understood that the gasket 210 may have a different shape. For example, the gasket 210 may comprise four linear segments, all separate from one another, that are located with respect to one another in the general shape of a rectangle. In another example, the gasket 210 may only comprise two linear segments, oppositely spaced from one another.

Reference will now be made to assembly of the first embodiment of the jumper drain assembly 200 and its installed location within the refrigerator 100. It is to be understood that the below-detailed steps are only an example of assembly, and that said steps need not occur in the specified order or in the exact manner. Further, while the below-disclosure relates specifically to the first embodiment of the jumper drain assembly 200, it is to be understood that the same or similar steps can be used during assembly of the additional jumper drain assembly embodiments, discussed further below.

Figure 9:
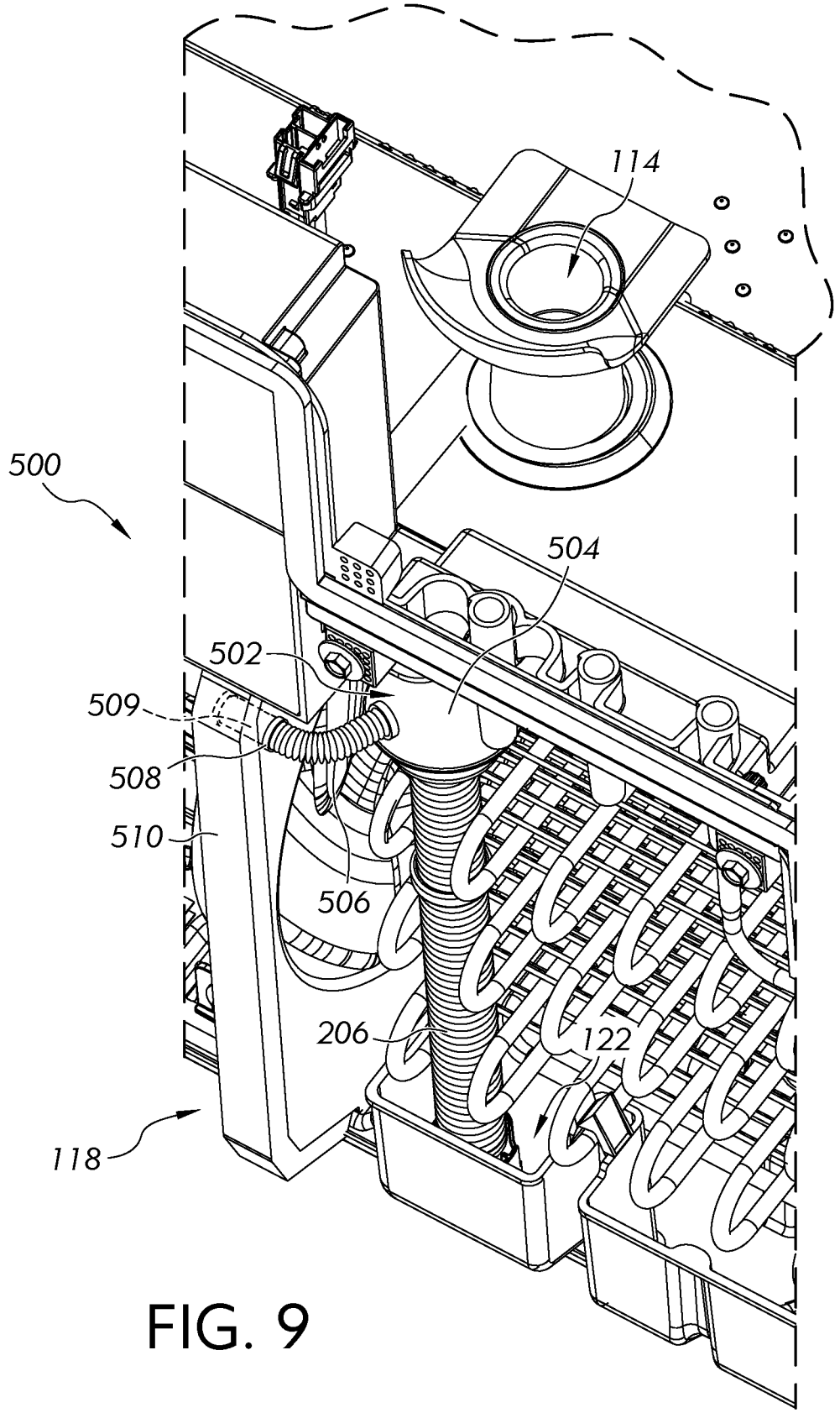
FIG. 9 is a perspective view of the machine compartment, including a fourth embodiment of a jumper drain assembly.

Initially, the first conduit 204 is fluidly connected to the interior cabinet drain 114 (drain 114 is shown best in FIG. 9). This may be accomplished by directly connecting one end of the first conduit 204 to an outlet (not shown) of the drain 114, or even by placing the one end of the first conduit 204 adjacent to the outlet (such that they are coaxial), while at a spaced distance therefrom. Next, the jumper drain 202 is placed within the machine compartment 116 such that the lid 218 is disposed adjacent (i.e., below) a top wall thereof and such that the jumper drain 202 resides on the negative pressure side of the condenser fan 118. In this position, the other end of the first conduit 204 is physically connected to (e.g., inserted into) the inlet 228 of the housing 212. As shown in FIG. 2, when the jumper drain 202 is in its assembled position, the face 234 of the housing 212 faces outwards and away from the machine compartment 116 (i.e., away from the refrigerator 100 and towards the ambient environment).

After the inlet 228 of the housing 212 is connected to the first conduit 204, the jumper drain 202 is configured to swivel or rotate about an axis (e.g., a central, longitudinal axis of the drain 114). That is, an operator can swivel/rotate the jumper drain 202 to arrange the jumper drain 202 in its properly assembled position (i.e., the jumper drain 202 is rotated to a position where the equalizer opening 232 is located at a rear-most side of the machine compartment 116, as depicted in FIG. 2). Thereafter, one end of the second conduit 206 is physically connected to the outlet 230 of the jumper drain 202, and the other end of the second conduit 206 is positioned within the drain pan 122. The above-noted swiveling motion of the jumper drain 202 permits the second conduit 206 to be positioned along a relatively large arc-path so that the second conduit 206 can be aligned with the drain pan 122.

Accordingly, when the liquid condensate drips from the freezer evaporator 112, the liquid condensate is collected by the drain 114 (shown in FIG. 9) and is funneled to the first conduit 204. The liquid condensate then enters the jumper drain 202 (via the inlet) and is guided (via gravity and the inner guiding surface 226) to the outlet 230 such that the liquid condensate is directed to the drain pan 122 via the second conduit 206. The liquid condensate is collected in the drain pan 122 and may even be evaporated via operation of the condenser fan 118.

Figure 6:
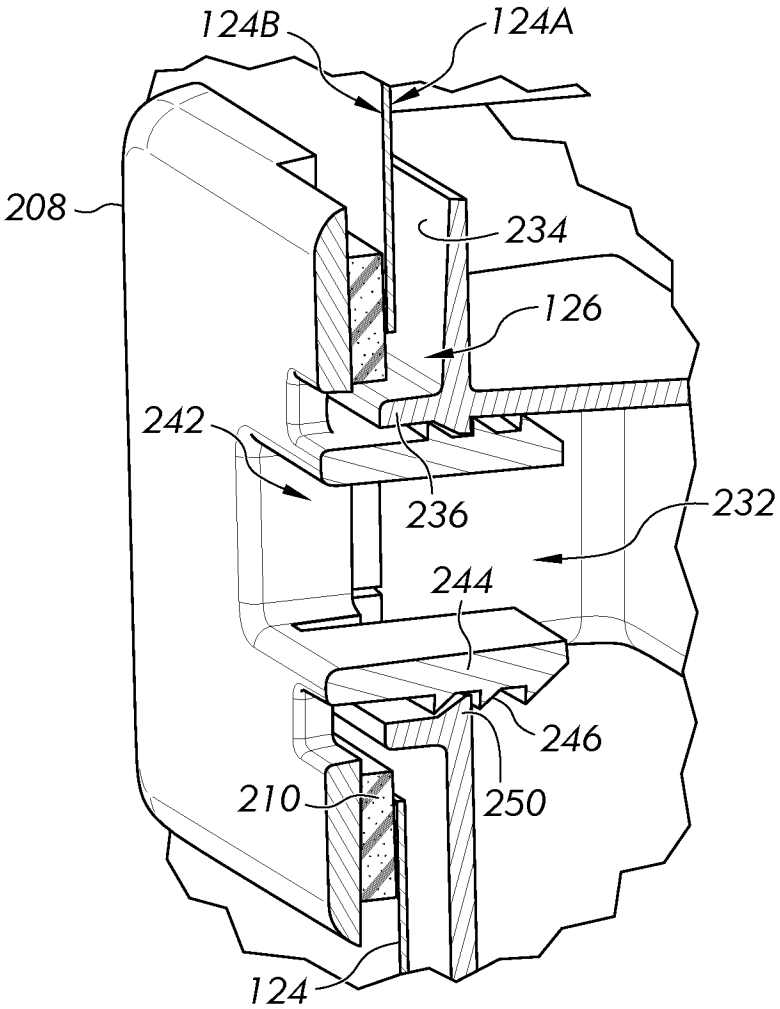
FIG. 6 is a cross-sectional view of the first embodiment of the drain jumper assembly installed in the refrigeration appliance.

After the jumper drain assembly 200 is installed within the refrigerator 100, an access panel 124 (shown in FIG. 6) is removably connected to the rear side of the cabinet 110 in order to enclose and conceal the machine compartment 116. As shown in FIG. 6 (depicting a cross-sectional view of the cover plate 208 attached to the jumper drain 202), the access panel 124 has a through-hole 126 formed therein that is configured to accept the peripheral wall 236 of the housing 212. More specifically, the access panel 124 is installed such that the face 234 of the housing 212 is disposed adjacent an inner surface 124A of the access panel 124, and such that the wall 236 protrudes through the through-hole 126 and extends outwards therefrom. Thereafter, the gasket 210 is disposed adjacent an outer surface 124B of the access panel 124 and is aligned with the equalizer opening 232 such that the gasket 210 peripherally surrounds the wall 236 of the housing 212. Finally, the cover plate 208 is aligned with the jumper drain 202 (such that the aperture 242 is coaxial with the equalizer opening 232) and is translated such that the tabs 244 are received within the equalizer opening 232. The ridges 246 engage with an inner lip 250 of the equalizer opening 232 (in a ratchet-like manner) in order to secure the cover plate 208 to the jumper drain 202. In this manner, not only is the cover plate 208 secured to the jumper drain 202, but the gasket 210 (being disposed between the outer surface 124B of the access panel 124 and the rear surface of the cover plate 208) is forcibly secured (i.e., pressed/compressed) against the outer surface 124B of the access panel 124 in order to create/maintain a seal therebetween. Additionally, the compressible nature of the gasket 210 reduces and/or eliminates vibration from the operative components of the machine compartment 116 (i.e., compressor, condenser fan 118, etc.) from being transmitted between the access panel 124 and the jumper drain 202 or cover plate 208. This can reduce and/or eliminate rattling or other undesirable noises when the refrigerator 100 is in operation.

Due to the above-noted design/configuration, the probability of generating the undesired vacuum is reduced and/or eliminated. Specifically, as mentioned above, the interior volume of the jumper drain 202 is in fluid communication with at least the freezer compartment 104 of the refrigerator 100 (via the fluid connection between the freezer compartment 104 and the drain 114, and the fluid connection between the drain 114 and the jumper drain 202). Accordingly, because the jumper drain 202 is in fluid communication with the ambient environment (via the equalizer opening 232 formed therein), this results in the freezer compartment 104 being in fluid communication with the ambient environment at all times. In this manner, even when a pressure differential is generated within the refrigerator 100, that pressure differential is quickly equalized, thus reducing or eliminating the formation of the vacuum within the refrigerator 100.

Figure 7:
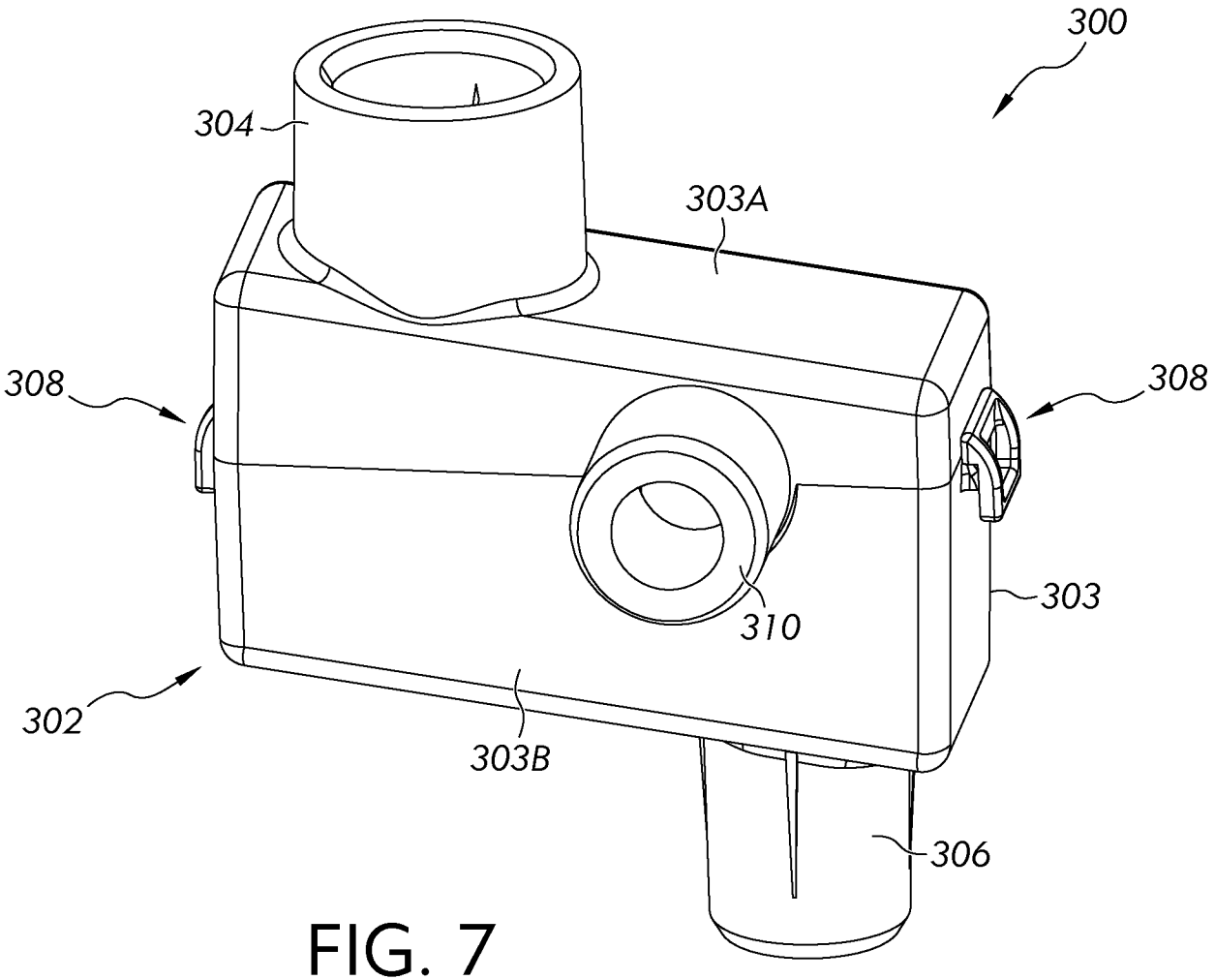
FIG. 7 is a perspective view of an example jumper drain of a second embodiment of a jumper drain assembly.

Now with reference to FIG. 7, select features of a second example embodiment of a jumper drain assembly 300 are shown in a perspective view. Unless otherwise stated, it is to be understood that the second example embodiment of the jumper drain assembly 300 functions in the same or a substantially similar manner to the first example embodiment of the jumper drain assembly 200.

As shown, the jumper drain assembly 300 includes a jumper drain 302 having a body 303 with an inlet 304 and an outlet 306. Similar to the first example embodiment, the inlet 304 and the outlet 306 are offset from one another, extend in opposite (vertical) directions away from the body 303, and are both in fluid communication with a cavity (not shown) defined within the body 303. The inlet 304 and the outlet 306 are depicted as hollow cylinders, but as explained above, may be in the form of any other shape. Further, the body 303 is shown in a split construction, having a first portion 303A and a second portion 303B. The inlet 304 can be formed integral with first portion 303A of the body 303 (i.e., during a single manufacturing process), or can be formed separate and distinct therefrom and subsequently secured thereto. Similarly, the outlet 306 can be formed integral with the second portion 303B of the body 303, or can be formed separate therefrom and subsequently secured thereto. The first and second portions 303A, 303B of the body 303 are removably secured to one another via clip-tab engagements 308 or any other known means of securement. Moreover, the first and second portions 303A, 303B may be hingedly secured to one another, as discussed above.

The jumper drain 302 further includes a pressure equalizing conduit 310 extending outwards therefrom. The equalizing conduit 310 is shown in the shape of a hollow cylinder and is in fluid communication with the cavity defined in the body 303. More specifically, the equalizing conduit 310 can be formed integral with the first portion 303A of the body 303 (i.e., during a single manufacturing process), or can be formed separate and distinct therefrom and subsequently secured thereto. Alternatively, the equalizing conduit 310 can be formed integral with the second portion 303B of the body 303, or can be formed separate therefrom and subsequently secured thereto. Optionally, the equalizing conduit 310 could be partially formed together with each of the first and second portions 303A, 303B, and brought together as a cylindrical shape when the body 303 is assembled, as shown in FIG. 7.

Assembly and functionality of the second example embodiment of the jumper drain assembly 300 is substantially similar to that of the first example embodiment, discussed above. For example, the first and second conduits 204, 206 are connected to the inlet 304 and the outlet 306, respectively, and the equalizing conduit 310 extends through the through-hole 126 formed in the access panel 124 in order to place the cavity of the jumper drain 302 in fluid communication with the ambient environment. Of note, the second example embodiment of the jumper drain assembly 300 may optionally include a similar cover plate and gasket, as described above with reference to the first example embodiment of the jumper drain assembly 200. That is, the cover plate 208 and gasket 210 are not necessary for the jumper drain assembly 300 to function properly. Moreover, it is to be understood that the equalizing conduit 310 itself can extend directly through the access panel 124 (i.e., at the through-hole 126), or alternatively, that an extension conduit (e.g., a corrugated tube, not shown) can be attached to the distal end of the equalizing conduit such that the extension conduit extends through or is disposed adjacent the corresponding through-hole 126 in the access panel 124.

Figure 8:
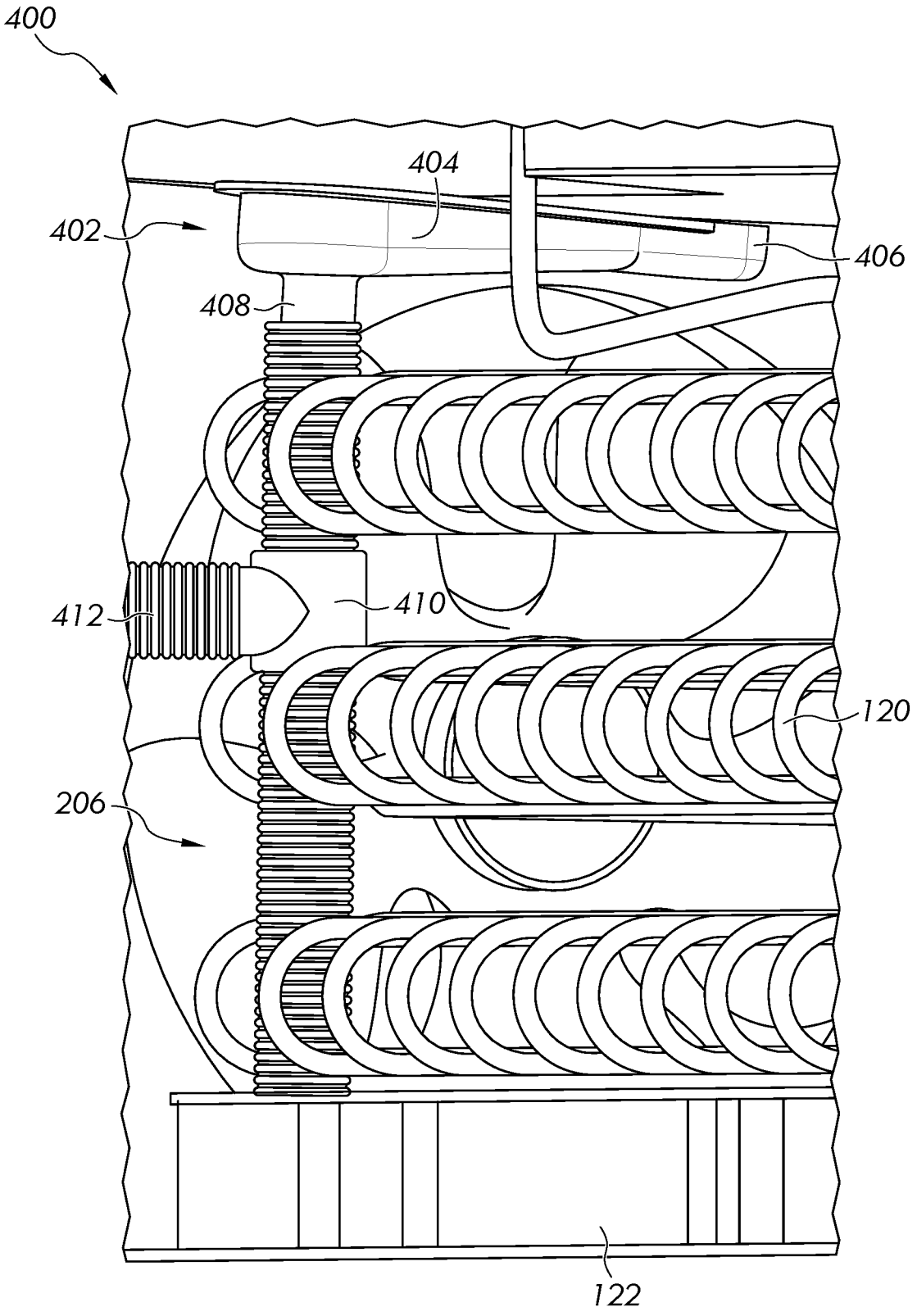
FIG. 8 is a perspective view of the machine compartment, including a third embodiment of a jumper drain assembly.

Now with reference to FIG. 8 (which is a side view within the machine compartment 116), select features of a third example embodiment of a jumper drain assembly 400 are shown. Unless otherwise stated, it is to be understood that the third example embodiment of the jumper drain assembly 400 functions in the same or a substantially similar manner to the first example embodiment of the jumper drain assembly 200.

As shown, the jumper drain assembly 400 includes a jumper drain 402 having a body 404 with an inlet 406 and an outlet 408. Similar to the first example embodiment, the inlet 406 and the outlet 408 are offset from one another, extend in opposite (vertical) directions away from the body 404, and are both in fluid communication with a cavity (not shown) defined within the body 404. Assembly of the third example embodiment of the jumper drain assembly 400 is substantially similar to that of the first example embodiment, discussed above. For example, the first and second conduits 204, 206 are connected to the inlet 406 and the outlet 408, respectively.

In contrast to the respective jumper drains 202, 302 of the first and second example embodiments discussed above, the jumper drain 402 has no equalizing opening/conduit formed therein. Rather, as shown, the second conduit 206 includes a 'T'-shaped connector 410 having a pressure equalizer conduit 412 configured to extend outwards through the through-hole 126 formed in the access panel 124 in order to place the cavity of the jumper drain 402 in fluid communication with the ambient environment.

The fourth example embodiment of the jumper drain assembly 400 is particularly advantageous for existing (e.g., in use) refrigerators 100, as the 'T'-shaped connector 410 can easily be retrofit to the jumper drain 402 to provide the equalizing advantage (discussed above). For example, the existing second conduit 206 can be divided (i.e., cut) into two separate sections, and subsequently joined together by the 'T'-shaped connector 410. Thereafter, the equalizer conduit 412 of the 'T'-shaped connector 410 is positioned to extend through the access panel 124 (e.g., via a pre-existing through-hole 126, or a newly made aperture) to place the cavity of the jumper drain 402 in fluid communication with the ambient environment. That is, because the second conduit 206 is in fluid communication with the interior of the jumper drain assembly 400, the equalizer conduit 412 can thereby provide the fluid communication with the ambient environment. Alternatively, the 'T'-shaped connector 410 can be formed integral with a new conduit, such that during installation, the entire second conduit 206 is replaced by said new conduit (including the 'T'-shaped connector 410) in order to provide the existing refrigerator with the above-noted technical advantage.

Finally, with reference to FIG. 9 (which is a perspective view of the machine compartment 116), select features of a fourth example embodiment of a jumper drain assembly 500 are shown. Unless otherwise stated, it is to be understood that the fourth example embodiment of the jumper drain assembly 500 functions in the same or a substantially similar manner to the first example embodiment of the jumper drain assembly 200.

As shown, the jumper drain assembly 500 includes a jumper drain 502 having a body 504 that defines a cavity (not shown) therein. While not specifically shown, it is to be understood that the jumper drain 502 likewise includes an inlet and an outlet, as mentioned above with respect to the other example embodiments. The jumper drain 502 further includes a pressure equalizing conduit 506 extending outwards from the body 504 and connected to a ferrule 508 provided on a shroud 510 of the condenser fan 118. The ferrule 508 provides a through-hole (i.e., an open passageway 509) in the shroud 510 in order to provide fluid access to the non-negative pressure side (e.g., a positive pressure side) of the condenser fan 118 within the machine compartment 116. That is, the open passageway 509 extends completely through the shroud 510 of the condenser fan 118 to thereby enable fluid communication between the negative and positive pressure sides of the condenser fan 118 (i.e., as shown in FIG. 3, the negative and positive pressure sides of the condenser fan 118 being the locations where arrows A1 and A2 are disposed, respectively).

In an assembled state, as shown, the equalizing conduit 506 is connected to the ferrule 508 of the shroud 510 in order to fluidly connect the cavity of the jumper drain 502 and the non-negative pressure side of the condenser fan 118. Of note, the equalizing conduit 506 is preferably corrugated, in order to promote easy manipulation of the equalizing conduit 506 during installation. In operation, because the jumper drain 502 is in fluid communication with the non-negative pressure side of the condenser fan 118 (via the equalizing conduit 506 being connected to the ferrule 508 of the shroud 510), this results in the freezer compartment 104 being in fluid communication with the non-negative pressure side of the condenser fan 118 at all times. In this manner, even when a pressure differential is generated within the refrigerator 100, that pressure differential is quickly equalized, thus reducing or eliminating the formation of the vacuum within the refrigerator 100.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A jumper drain for a refrigerator appliance that provides fluid communication between a storage compartment and a machine compartment via a drain that collects and transfers liquid condensate from an evaporator, the jumper drain comprising:

a housing extending longitudinally between opposite first and second ends and defining a cavity therein, the cavity being in fluid communication with the storage compartment;

an inlet adjacent the first end and extending from the housing and in fluid communication with the cavity;

an outlet adjacent the second end and extending from the housing and in fluid communication with the cavity, the outlet being disposed at a location that is offset from the inlet; and a pressure equalizer opening formed in a planar face of the housing provided at the second end thereof, wherein the pressure equalizer opening is configured to provide fluid communication between the cavity and an ambient environment external to the refrigerator appliance in order to equalize a pressure differential within the refrigerator appliance, wherein a wall projects outwards from an external surface of the planar face in a direction away from the housing, and wherein the wall peripherally surrounds the pressure equalizer opening.

2. The jumper drain of claim 1, wherein the inlet and the outlet are disposed at opposite respective ends of the housing, and wherein the inlet and the outlet extend in opposite respective directions away from the housing.

3. The jumper drain of claim 1, the housing having an inner guiding surface within the cavity that is configured to guide a flow of said liquid condensate from the inlet to the outlet, and wherein the inner guiding surface is sloped vertically downwards from the inlet to the outlet.

4. The jumper drain of claim 1, wherein the housing comprises a body and a lid, the lid being movable to provide selective access to the cavity, wherein a first section of the wall protrudes from the body and a second section of the wall protrudes from the lid.

5. The jumper drain of claim 1, wherein the housing comprises a body and a lid, the lid being pivotably attached to the body at a side thereof via a hinge such that the lid is pivotable between an opened state and a closed state.

6. The jumper drain of claim 5, wherein first and second cutout portions are formed in the body and the lid, respectively, such that when the lid is provided in the closed state, the first and second cutout portions define the pressure equalizer opening.

7. The jumper drain of claim 1, wherein the pressure equalizer opening provides fluid communication between the cavity and the ambient environment at all times.

8. An appliance comprising:

a cabinet defining a storage compartment for storing food items in a cooled environment;

an evaporative cooling system configured to reduce a temperature of the storage compartment, the evaporative cooling system including an evaporator, a condenser, and a condenser fan, wherein the evaporator is positioned within the storage compartment, and wherein the condenser and the condenser fan are positioned within a machine compartment disposed beneath and external to the storage compartment;

a drain disposed below the evaporator and configured to collect and transfer liquid condensate from the evaporator, the drain being in fluid communication with the storage compartment; and a jumper drain comprising a housing extending longitudinally between opposite first and second ends and defining a cavity therein, the cavity being in fluid communication with the drain, wherein an inlet and an outlet are disposed adjacent the first end and the second end, respectively, and are in fluid communication with the cavity, wherein a pressure equalizer opening is formed in a planar face of the housing provided at the second end thereof, wherein the pressure equalizer opening provides fluid communication between the cavity and an ambient environment external to the appliance, thereby providing fluid communication between the storage compartment and the ambient environment in order to equalize a pressure differential within the appliance, wherein a wall projects outwards from an external surface of the planar face in a direction away from the housing, and wherein the wall peripherally surrounds the pressure equalizer opening.

9. The appliance of claim 8, wherein the jumper drain is disposed within the machine compartment and is provided on a negative pressure side of the condenser fan.

10. The appliance of claim 8, wherein a first conduit connects the drain to the inlet, and wherein a second conduit is connected to the outlet and is configured to guide a flow of said liquid condensate to a drain pan positioned in the machine compartment.

11. The appliance of claim 10, wherein the inlet and the outlet extend in opposite respective directions away from the housing.

12. The appliance of claim 8, further comprising a panel removably connected to the cabinet to enclose and conceal the machine compartment, wherein the external surface of the planar face of the housing is disposed adjacent an inner surface of the panel, and wherein the wall is received by and extends through a through-hole formed in the panel.

13. The appliance of claim 12, further comprising a cover plate disposed adjacent an external surface of the panel, the cover plate having an aperture formed therein that is coaxial with the pressure equalizer opening, wherein a gasket is provided between the cover plate and the external surface of the panel, and wherein the gasket peripherally surrounds the wall.

14. The appliance of claim 13, the cover plate comprising a tab extending outwards and away therefrom, the tab having at least one ridge configured to engage an inner lip of the pressure equalizer opening in order to secure the cover plate to the housing, and to press the gasket into physical contact with the external surface of the panel.

15. The appliance of claim 8, wherein the housing comprises a body and a lid, the lid being movable between a closed state and an open state to provide selective access to the cavity, wherein first and second cutout portions are formed in the body and the lid, respectively, such that when the lid is provided in the closed state, the first and second cutout portions define the pressure equalizer opening.

16. The appliance of claim 15, wherein the lid is pivotably attached to the body at a side thereof via a hinge such that the lid is pivotable between the closed state and the open state.

17. A jumper drain for a refrigerator appliance that provides fluid communication between a storage compartment and a machine compartment via a drain that collects and transfers liquid condensate from an evaporator, the jumper drain comprising:

a housing extending longitudinally between opposite first and second ends and including a body and a lid that collectively define a cavity within the housing, the lid being pivotably attached to the body at a side thereof via a hinge such that the lid is pivotable between a closed state and an open state, the housing being disposed within the machine compartment and on a negative pressure side of a condenser fan;

an inlet and an outlet disposed at the first and second ends of the housing, respectively and extending in opposite respective directions away from the body, the inlet being configured to engage with a first conduit that provides fluid communication between the drain and the cavity, and the outlet being configured to engage with a second conduit that guides a flow of said liquid condensate to a drain pan; and a pressure equalizer opening formed in a planar face of the housing provided at the second end thereof, the pressure equalizer opening providing fluid communication between the cavity and an ambient environment external to the refrigerator appliance in order to equalize a pressure differential within the refrigerator appliance, wherein a wall projects outwards from an external surface of the planar face in a direction away from the housing, the wall peripherally surrounding the pressure equalizer opening, and wherein first and second cutout portions are formed in the body and the lid, respectively, such that when the lid is provided in the closed state, the first and second cutout portions define the pressure equalizer opening.

* * * * *